United States Patent [19]

Intengan

[11] 4,173,792

[45] Nov. 13, 1979

[54] ADJUSTABLE LENGTH SIMULATED KNOTTED NECKTIE COMBINATION

[76] Inventor: Franklin S. Intengan, 666 W. 81 St., Apt. W-122, Hialeah, Fla. 33014

[21] Appl. No.: 894,187

[22] Filed: Apr. 6, 1978

[51] Int. Cl.[2] ..... A41D 25/02

[52] U.S. Cl. ..... 2/144; 2/148; 2/150

[58] Field of Search ..... 2/144, 145, 148, 149, 2/150, 152 R, 152 A, 153

[56] References Cited

U.S. PATENT DOCUMENTS

| | | | |
|---|---|---|---|
| 1,324,740 | 12/1919 | Hendrix | 2/148 |
| 1,949,851 | 3/1934 | Alper | 2/150 |
| 2,936,462 | 5/1950 | Williams et al. | 2/150 |
| 2,943,331 | 7/1950 | Toplansky | 2/150 |
| 3,060,448 | 10/1962 | Mongelli | 2/150 |

*Primary Examiner*—Louis Rimrodt

[57] ABSTRACT

An adjustable length simulated knotted necktie combination composed of a necktie length having a front display tail portion and an opposite rear tail portion with an intermediate portion and an inverted trapezoidally shaped body of simulated knot shape as seen in front elevation and which body has an upper support surface to engage the intermediate portion of the necktie length between the tail portions to support the upper zone of the display tail portion adjacent the intermediate portion over the simulated knot shaped body and including a shield to wrap about the body and over the upper zone of the display tail portion and wherein neck engaging segments with quick release elements such as snaps are provided to serve as a neckband for attachment in the collar of the shirt of a wearer and which combination simulates a conventional knotted tie, is adjustable, washable, easy to assembly and is removable from the neck of the wearer by unsnapping the neck segments.

16 Claims, 12 Drawing Figures

ADJUSTABLE LENGTH SIMULATED KNOTTED NECKTIE COMBINATION

FIELD OF THE INVENTION

This invention relates to neckwear and, more particularly, to an adjustable length simulated knotted necktie combination.

SUMMARY OF THE INVENTION

The present invention comprises an adjustable length simulated knotted necktie combination comprising (a) a tie length having a display tail portion, a rear tail portion and an intermediate portion, (b) a body in the form of a trapezoid which is inverted to support the intermediate portion, (c) a shield means to overlay the central portion on the body simulating a knot of predetermined size and configuration, and (d) neck engaging segments for releasably connecting the combination about the neck of a wearer.

BACKGROUND OF THE INVENTION

The present invention relates to ties worn by persons and provides an adjustable length tie or tie display tail. As is perhaps well known, a conventional necktie is positioned in the shirt collar and about the neck of a wearer, adjusted for estimated length and then knotted and tightened to a convenient feel about the wearer's neck. This presents many problems which have been recognized in the art. The problems arise because a neat appearing knot requires considerable expertise and moreover considerable dexterity is required which is especially troublesome to those having arthritis, for example. It is very difficult to tie a knot in such a way that the display tail length is precisely correct in that the display tail extends from the neck to the belt line of the wearer. Oftentimes the display tail is too short for the height of the wearer or too long for the height of the wearer. Oftentimes, a person to secure the correct tie display tail length is required to tie the knot several times in order to achieve the personal satisfaction required. Oftentimes, this wears out the central display portion of the tie and causes it to have a short life and to have excessive greasy finger marks.

PRIOR ART

In the past there have been numerous types of pre-knotted ties. Some have utilized hook means to hook over the front of the shirt of the wearer and a stiffening flexible plate of fixed dimensions for a display tail length of a predetermined non-adjustable length. Various other types of neckwear are known in the art as is described in the following paragraph.

In the past, the problems of neckwear have been amply described in the literature including, among other patents, the following, known to the inventor: U.S. Pat. No. 2,530,975 wherein the tail section is not adjustable as a practical matter and comprises a different method of attachment to the collar of the shirt of a wearer than does the instant disclosure; U.S. Pat. No. 2,915,757, which is of a knot cover composed of a triangular piece of fabric material which is snapped over a necktie knot. It provides no structural shape defining a shell in the form of the knot and does not provide an adjustable tail. U.S. Pat. No. 3,030,631, a necktie is taught which is not adjustable in length and provides no knot defining structure; U.S. Pat. No. 3,369,257 is of a pre-tied tailless necktie with collar engaging wing-type members; U.S. Pat. No. 3,735,420, a neckband with a reversible tie assembly wherein the tail is not adjustable and is impaled by a pin designated by the numeral 6 into a body which is pivotal on the pin and comprising a reversible tie; and U.S. Pat. No. 3,955,217, a tail section length which is not adjustable which provides an eyelet type of connection for a neckband.

OBJECTS OF THE INVENTION

It is, generally speaking, an object of this invention to provide an adjustable length simulated pre-knotted tie combination which may be readily applied by a wearer about his neck after a first adjustment of the desired length of the display tail of the tie with respect to an inverted trapezoidal shaped body of predetermined size and configuration simulating a knot and with the display tail portion of the tie at its upper end being adjustably connected to the body and caused to simulate a knot at that zone of connection by means of a shield, of similar or contrasting fabric to that of the display tail, which shield is adapted to wrap about the body and be joined together captivating the body and display tail in the position of first adjustment and subject to a second or final precise adjustment; and wherein the combination includes a neck engaging band which includes quick release means so that the tie may be jerked from the neck of a wearer for subsequent use or for safety purposes in the event that it is caught in machinery, and which device can be taken apart readily when not in use and be easily cleaned when desired.

It is an object of this invention to provide an adjustable length tie which can be readily assembled and worn, and which includes a separate shield piece to cover a simulated knot body over which the tie is arranged and after assembly, the tie display tail may be readily adjusted to the precise preferred length by the wearer.

It is another object of this invention to provide a body composed of a shell type structure including guide means for arranging the tie portions relative to one another and which in the preferred embodiment is composed of a front and rear surface hingedly connected to one another and including internal guide means for arranging the central portion of the tie relative thereto and for accommodating sliding movement of adjustment of the display tail for a preferred length by a wearer.

It is another object of this invention to provide a combination as set forth which is adapted to utilize a wide variety of body shapes and sizes of generally truncated inverted trapezoidal form simulating Windsor type knots, four-in hand knots, and any other type of preferred neckwear knot so that the design of the wearer may be selected from an infinite variety depending upon the exact shape of the knot simulating body which is utilized.

Generally speaking, it is an object of this invention to provide an improved type of neckwear which includes a body to support a display tail tie length and which can vary in size and shape of generally truncated inverted type configuration, for the primary purpose of dictating the final form of a simulated knot which may have an infinite variety of shapes and sizes and wherein the tail portion is completely adjustable to the personal preference of the wearer and wherein once worn by a person, it may be quickly removed and, in one embodiment, quickly loosened and wherein other advantages and objects will become apparent on reference to the accompanying drawings and the description and claims following hereinafter.

In accordance with the foregoing objects and the general purposes of this invention, this invention will now be described with reference to the accompanying drawings, in which:

Figure 6:
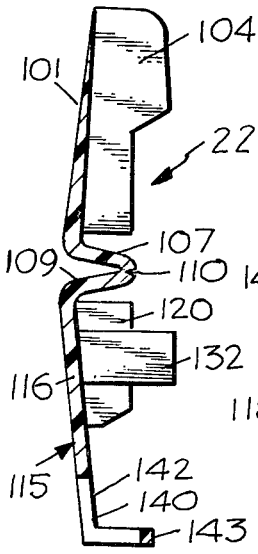
Figure 7:
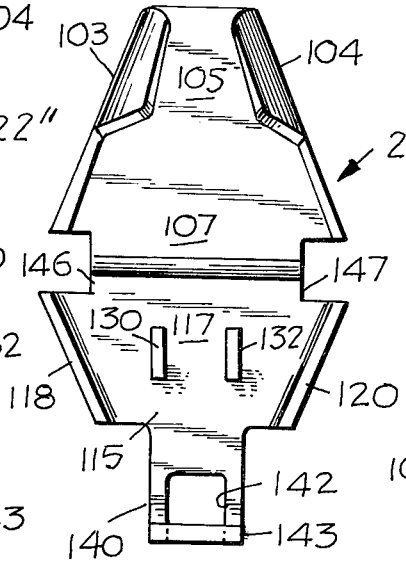
Figure 8:
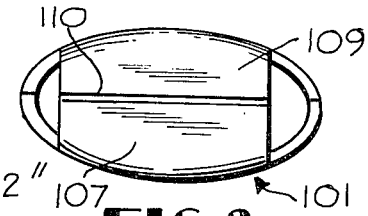
Figure 9:
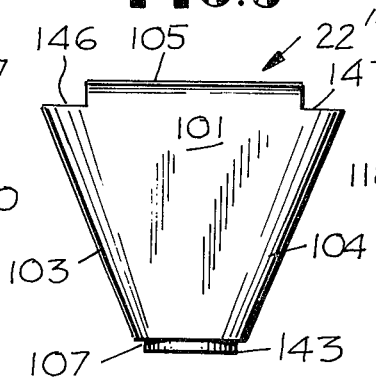
Figure 10:
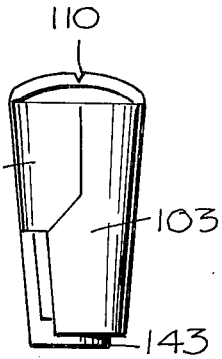

Referring now to the second sheet of the drawings and to FIGS. 6–12, an alternative embodiment of the instant invention is shown in which:

FIG. 6 is a view in cross section of a shell type body for use in making a simulated knot;

FIG. 7 is an elevation view of FIG. 6;

FIG. 8 is a top plan view of the shell type body of FIGS. 6 and 7 in a closed attitude;

FIG. 9 is an elevation view of the device shown in FIG. 8;

FIG. 10 is a side elevation view of the device shown in FIG. 9; and

Figure 11:
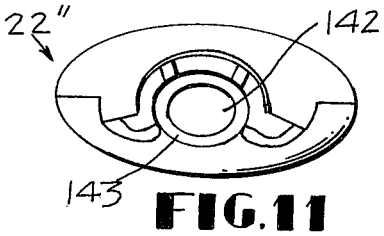

FIG. 11 is a bottom view of the device shown in FIGS. 6–10; and

Figure 12:
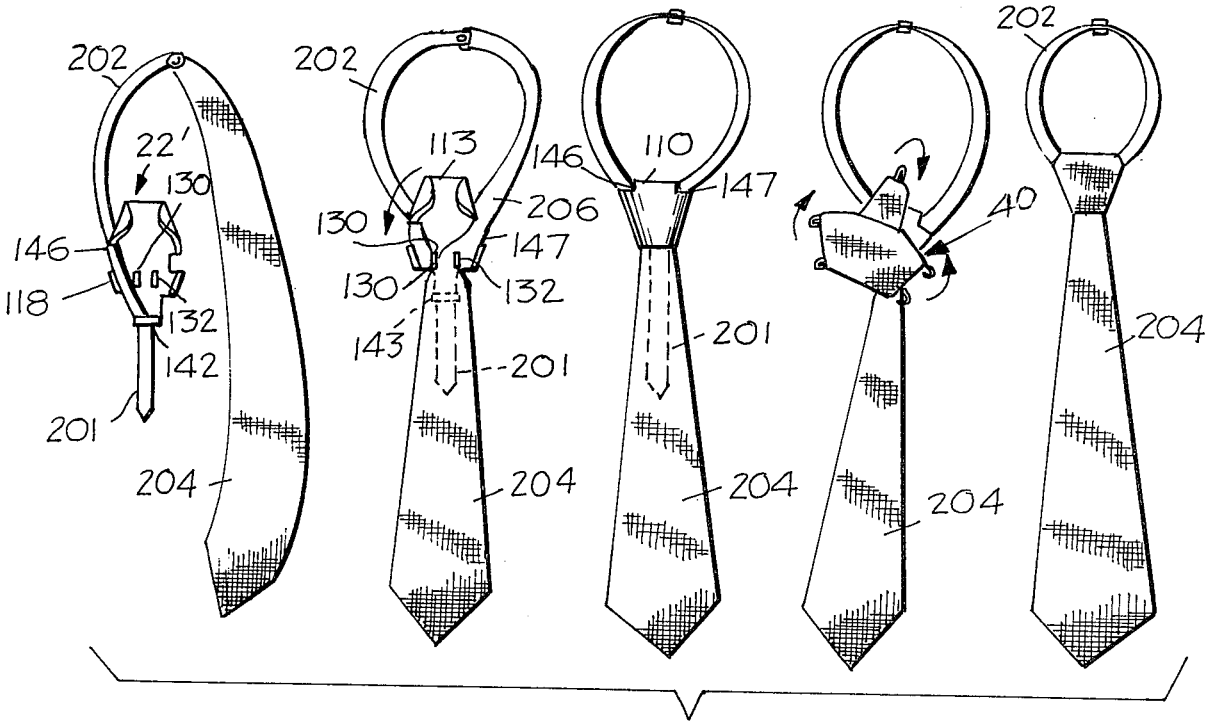

FIG. 12 is a sequence of views illustrating the utilization of the invention as is described hereinafter.

DESCRIPTION OF PREFERRED EMBODIMENTS

Figure 1:
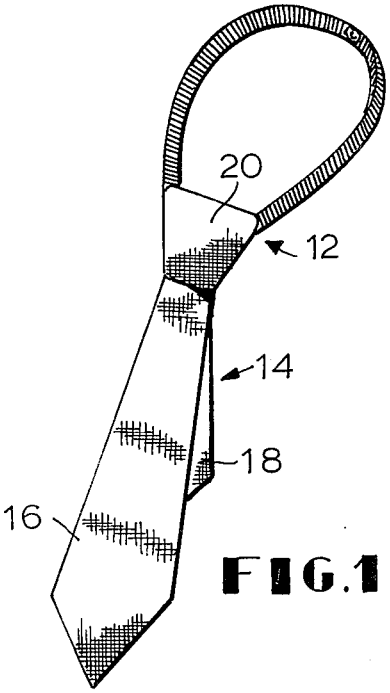
FIG. 1 is a perspective view of a first embodiment of the instant invention.
Figure 2:
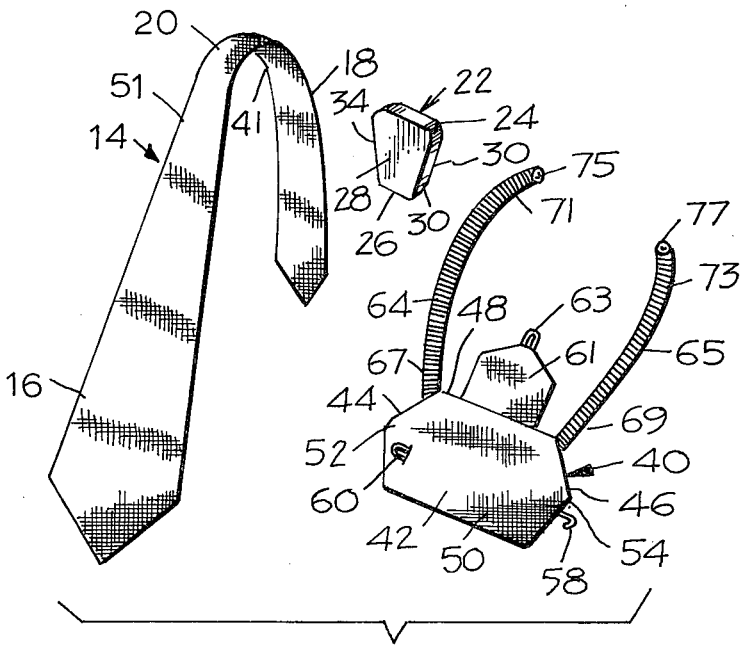
FIG. 2 is an exploded view illustrating the components of the simulated knotted tie shown in FIG. 1.

Referring to FIG. 1, there is shown the simulated knotted tie combination which is generally designated by the numeral 12 and which is composed of a conventional necktie length 14 having a front or display tail section 16, a rear tail section 18, and a central or intermediate portion between the tail sections 20, which in a conventional utilization extends around the neck of a wearer in the collar sandwich. In the instant invention, a body 22 is provided which is in the shape of a simulated knot as seen in elevation, that is, generally it is of an inverted trapezoidally shaped body or form having its base surface 24 comprising its upper surface and the narrower opposite surface 26 comprising its lower surface and these surfaces are connected by a front or main surface 28, rear surface 30, and side surfaces 32 and 34. Referring to the right of FIG. 2, there is shown a shield generally designated by the numeral 40 which comprises a simulated knot cover for the upper end of the display tail of the necktie when it is positioned over the front face or main surface 28 of the body 22. The shield will now be described, it first being appreciated that the central portion 20 or the upper end of the display tail and of the necktie is looped over the body 22 with the inside surface 41 overlaying the top surface 24 of the knot shape defining body and adjusted so that the front tail 16 is generally of an appropriate length. Thereafter, the shield is utilized to captivate the tie in that position on the body wherein it is adjustable lengthwise by tugging or pulling on the front display tail length 16 or the other tail length for a final adjustment of the length of the display tail of the tie.

Referring now to the shield 40, it is seen that it comprises a panel 42 having side edges 44 and 46 which diverge outwardly from the upper and lower edges 48 and 50 defining wings 52 and 54 so that the central portion is adapted to be positioned over the upper zone 51 of the front or display tail 16 of the tie when it is positioned in covering relation of the front or main face or surface 28 of the knot shape defining body with the wings 52 and 54 wrapped about the body side surfaces 32 and 34 and overlapped with respect to the terminal zones in overlaying overlapped relation on the back surface 30 of the simulated knot body or plug and fastened together by means of suitable fastening means such as the hook 58 and eye 60 respectively. In the preferred embodiment the shield includes a flap 61 extending centrally from the upper edge 48 to overlay the upper surface 24 of the body; and it includes an attachment means such as an eye 63 so that when the flap is wrapped about the top surface of the plug the eye 63 is adapted to engage and hook up with the aforementioned hook and eye means 58 and 60. Extending outwardly from the zone of the shield at about the location where the side edges 44 and 46 meet the upper edge 50 there are extending neckband segments 64 and 65 each having a proximal end 67 and 69 respectively. These segments are suitably connected to the shield panel as by stitching and the distal ends 71 and 73, which include fastening means comprising mutually interengaging snap elements 75 and 77, define the neckband adapted to encircle the neck of a wearer and to be fastened together beneath the collar.

Figure 3:
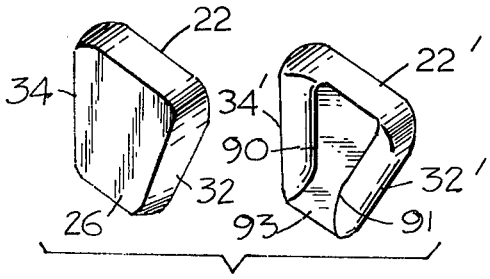
FIG. 3 is a view illustrating the simulated knot shaped inverted trapezoidal body shown in FIG. 2 and utilized in FIG. 1 and also illustrating an alternative embodiment in shell form of that body utilized in the simulated knot of FIGS. 4 and 5.
Figure 4:
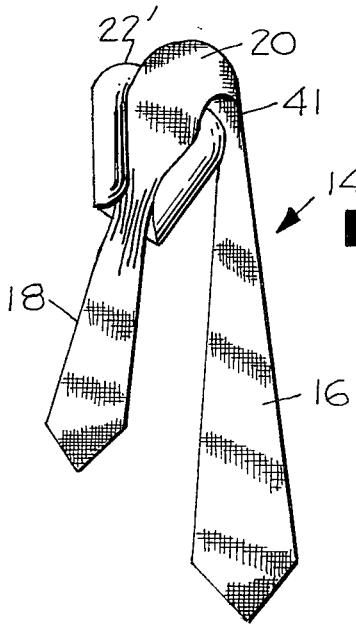
FIG. 4 is a perspective view illustrating the utilization of the shell type body shown at the right of FIG. 3 in making a simulated necktie knot.

Referring to FIG. 3, it is seen that the right-hand body 22' resembles the body 22 and provides the upper surface and side surfaces as well as the front surface 28; however, the interior is hollow defing a shell type body which may be of molded plastic in the rigid range. In this embodiment, the body does not have the lower surface designated by the numeral 26 in the solid type body 22 to the left of FIG. 3. The hollow interior between the inturned side surface portions 90 and 91 define a tie length guide track having a lower entrance mouth 93 to accommodate sliding passage of adjustment of the rear tail section 18 of the tie so that the main display length 16 may be adjusted by sliding movement of the central zone 20 over the top surface 22' of the shell type embodiment.

Figure 5:
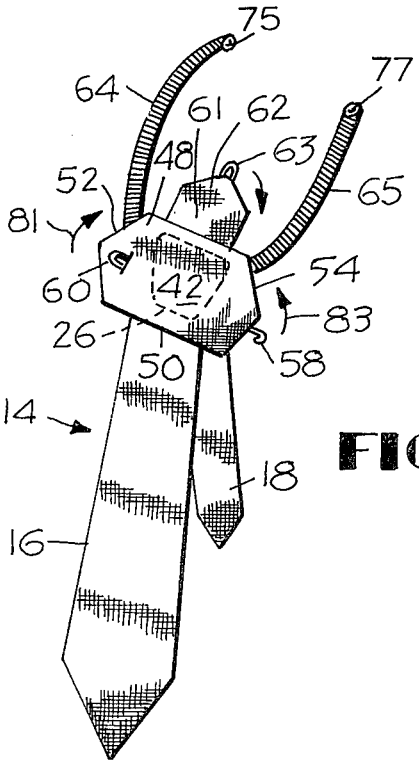
FIG. 5 is a view illustrating the completion of the simulated knot making process utilizing either of the simulated knot shaped bodies of FIG. 3 with a necktie length and the shield shown at the right of FIG. 2.

Referring to FIG. 5, it is seen that the arrowed lines 81 and 83 illustrates the wrap around relationship of the shield wings for wrapping about either type of the bodies shown in FIG. 3, that is the solid type 22 on the left or the shell type 22' on the right; and that the top flap 61 is wrapped over the top body surface 22 or 22' and connected by eye 63 on end zone 62 of the flap to the connector means 58 and 60 and that the neckband is connected about the neck of the wearer and supported together by the fastener means.

Referring to FIGS. 6 through 11, a modified structure for a simulated knot body to be used with the instant invention is illustrated. It is of shell form and may be of molded plastic material in the rigid range. The body is generally designated by the numeral 22'; however, a new series of numerals will be utilized for the parts of this knot shape defining body. It is seen that the body 22' is composed of a front face portion 101 having side face portions 103 and 104 which taper downwardly from a curved upper edge zone 105 to a lower edge 107. The upper curved zone 105 includes an extending top portion 107 which joins a complementary top portion 109 along a fold line or hinge line 110 which accommodates relative hinge-type action of the front face portion generally designated by the numeral 101 relative to the rear portion designated generally by the numeral 115. The rear portion includes a back face 116 with an inside surface 117 and side surface portions 118 and 120 which are companionately shaped to interengage with the companionate side surfaces of the front face portion 101. Extending in perpendicular relation from the inside rear surface 117 within the shell type body there are two parallel spaced centrally arranged, spaced guide pins or lugs 130 and 132 for a purpose to be explained on reference to FIG. 12. The lower portion of the back portion 115 of the simulated knot body or shell body is provided with a depending portion 140 having a hold 142 therethrough and a lower outturned front rib 143. Further, the top surface 105 is cut away as at 146 and 147 defining top surface support portions for a purpose that will be apparent in the following paragraph in connection with the use of this embodiment.

Referring to FIG. 12, it is seen that the rear tie tail portion 201 is threaded through the opening 142 and extended upwardly within the body and between the guide member 130 and the side 118 and out of the cutout 146 with the intermediate or central portion 202 extending outwardly. The front or display tail length 204 at its upper zone 206 is threaded down through the cutout portion 147 and between the guide members 130 and 132 and over the rib 142 downwardly from the body with the zone 206 of the tie overlaying the front face 143 of the rib 142 defining a smooth or fair curved form. Thereafter, the rear portion of the shell body 113 is folded downwardly about the hinge line 110 into the position shown in FIG. 12. The keeper shield 40 is next applied. The shield is the same generally, as that shown in FIG. 2 and hence it is not hear redescribed with the exception of noting that the neckband segments are not included on the shield. The shield is positioned about the simulated knot defined by the shell type body 22" with the result that the simulated knot is as appears at the right of FIG. 12. In this embodiment the neckband segments may be threaded about the shirt neck zone of a wearer; i.e., beneath the collar and, if desired, the length of the display tail can be adjusted by holding the knot and tugging or pulling on either of the tail sections and sliding it with respect to the shell type body. Also, the this embodiment the tightness of the loop about the neck of a wearer may be readily adjusted.

What is claimed is:

1. A simulated knotted necktie combination for a wearer comprising:

a necktie length having a front display tail portion and a rear tail portion and an intermediate portion between the tail portions, said front display tail portion having a zone adjacent said intermediate portion, a simulated knot shaped body comprising means to predetermine the size and shape of a simulated knot, said body having a top and side surfaces and a front surface, said body being of generally inverted trapezoidal form as seen in front elevation and said top surface comprising a necktie length support when said necktie length is arranged with the zone of said front display tail overlaying said front surface of said simulated knot shaped body and the front display tail portion and rear tail portions extend in a common direction from the body and away from the top body surface; and shield means comprising means to slidably connect the necktie length to the simulated knot shaped body and to orient and hold the zone of the length in a simulated knot shape, said shield comprising a panel having spaced upper and lower edges, said panel being sized to cover the front face of said body, said panel having wrap around side flaps between the upper and lower edges to cover the side surfaces of the body, said panel being positionable over said front face of said body and zone of the necktie length covering said front face and said flaps including connector means to interengage with one another to slidably captivate the display tail of the necktie length to the body with said zone overlaying the front face of said body and said shield including a cover flap extending from the upper shield edge sized to cover the top surface of the body and including means to connect the cover flap to the flaps of the shield, and neckband means included in said combination for connection of the simulated knotted necktie combination about the neck of a wearer.

2. The device as set forth in claim 1 wherein said body comprises a solid plug.

3. The device as set forth in claim 1 wherein said body comprises a hollow rigid body.

4. The device as set forth in claim 3 wherein said hollow rigid body is of moldable rigid plastic material.

5. The device as set forth in claim 3 wherein said side surfaces of said body are turned back upon one another defining an entrance mouth.

6. The device as set forth in claim 1 wherein said neckband is composed of band segments and means to interconnect the band segments in neckband defining relation.

7. The device as set forth in claim 1 wherein said connector means comprises hook and eye means.

8. The device as set forth in claim 1 wherein said means to connect includes hook and eye means.

9. The device as set forth in claim 1 wherein said shield means includes means to connect the panel to the neckband means.

10. The device as set forth in claim 1 wherein said simulated knot shaped body comprises a top surface including hinge means interconnecting the front surface and a rear surface and guide means are provided within said body for orienting and aligning said necktie length in engagement with said body and slidably attached thereto by means of said shield means.

11. The device as set forth in claim 10 wherein said side surfaces of said body comprise interengaged portions on said front and rear surfaces.

12. The device as set forth in claim 11 wherein lateral rib orienting means are provided to provide a curvature for said necktie length display tail portion at said body.

13. The device as set forth in claim 1 wherein said shield means and said necktie length each include an outer surface of similarly decorative material.

14. The device as set forth in claim 13 wherein said material is of decorative cloth material.

15. The device as set forth in claim 1 wherein the front display tail portion is adjustable in length and wherein means for connecting the rear tail portion and front tail portion include quick disconnect means and the rear tail portion controls the tightness of fit around the wearer's neck.

16. The device as set forth in claim 1 wherein the front display portion, the rear display portion, and intermediate display portion are interconnected by means of a quick disconnect fastening means interconnecting the portions and the rear tail portion control the tightness of fit around the wearer's neck.

* * * * *